US008598498B2

(12) United States Patent
Lee et al.

(10) Patent No.: US 8,598,498 B2
(45) Date of Patent: Dec. 3, 2013

(54) PROCESSING CONTROLLER FOR DRIVING THE HEAT SOURCES OF A COOKER

(75) Inventors: Sang-Ryul Lee, Changwon (KR); Kyu-Young Kim, Changwon (KR); Jae-Myung Chin, Changwon (KR); Dong-Han Kim, Changwon (KR); Si-Young Choi, Changwon (KR); Sung-Ho Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 296 days.

(21) Appl. No.: 12/935,821

(22) PCT Filed: Apr. 3, 2009

(86) PCT No.: PCT/KR2009/001745

§ 371 (c)(1), (2), (4) Date: Mar. 2, 2011

(87) PCT Pub. No.: WO2009/145497

PCT Pub. Date: Dec. 3, 2009

(65) Prior Publication Data

US 2011/0165295 A1 Jul. 7, 2011

(30) Foreign Application Priority Data

| | | |
|---|---|---|
| Apr. 4, 2008 | (KR) | 10-2008-0031568 |
| Apr. 4, 2008 | (KR) | 10-2008-0031569 |
| Apr. 4, 2008 | (KR) | 10-2008-0031570 |
| Apr. 4, 2008 | (KR) | 10-2008-0031572 |
| Apr. 4, 2008 | (KR) | 10-2008-0031573 |
| Apr. 3, 2009 | (KR) | 10-2009-0028949 |

(51) Int. Cl.
*H05B 1/02* (2006.01)

(52) U.S. Cl.
USPC ..... 219/494; 219/497; 219/508; 219/492

(58) Field of Classification Search
CPC ..... H05B 1/03
USPC ..... 219/492, 494, 497, 506, 507, 508
See application file for complete search history.

(56) References Cited

FOREIGN PATENT DOCUMENTS

| | | |
|---|---|---|
| JP | 2004-111086 | 4/2004 |
| KR | 100125716 | 10/1997 |
| KR | 10-0131977 | 5/1998 |
| KR | 1998-057988 | 9/1998 |
| KR | 100178348 | 11/1998 |
| KR | 10-2001-0041754 | 5/2001 |
| KR | 10-2001-0041758 | 5/2001 |
| KR | 10-2003-0091964 | 12/2003 |
| KR | 10-0521083 | 10/2005 |
| KR | 10-2006-0081744 | 7/2006 |
| KR | 10-2006-0091857 | 8/2006 |
| KR | 10-0671842 | 1/2007 |

OTHER PUBLICATIONS

Korean Office Action dated Mar. 12, 2010. (10-2008-0031568).
Korean Office Action dated Mar. 15, 2010. (10-2008-0031569).
Korean Office Action dated Mar. 15, 2010. (10-2008-0031572).
International Search Report issued in PCT/KR2009/001745 dated Nov. 26, 2009.
Korean Notice of Allowance dated Sep. 7, 2010.
Korean Notice of Allowance dated Sep. 13, 2010.

*Primary Examiner* — Mark Paschall
(74) *Attorney, Agent, or Firm* — KED & Associates, LLP

(57) ABSTRACT

Provided are a cooker and a method for controlling the same. Levels driven by a plurality of heat sources are controlled by input driving levels of all the heat sources received by an input unit. Accordingly, there is an advantage in that foods are more swiftly cooked by the plurality of heat sources.

21 Claims, 4 Drawing Sheets

PROCESSING CONTROLLER FOR DRIVING THE HEAT SOURCES OF A COOKER

BACKGROUND OF THE INVENTION

1. Field of the Invention

The present disclosure relates to a cooker, and more particularly, to a cooker including a plurality of heat sources for heating foods and a method for controlling the same.

2. Description of Related Art

Cookers are home appliances for heating foods. Cookers include various heat sources to provide heat for heating foods. Examples of heat sources include heaters for radiation and convective heating and magnetrons for generation of microwaves. Recently, home appliances including a plurality of heating sources for quicker heating of foods have been widely introduced.

SUMMARY OF THE INVENTION

Technical Problem

Embodiments provide a cooker that can more quickly and efficiently heat foods and a method for controlling the same.

Technical Solution

In one embodiment, a cooker includes: a cooking chamber in which food is cooked; a first heat source and a plurality of second heat sources providing heat to heat food in the cooking chamber; and an input unit receiving driving temperatures of the first and second heat sources as respective preset driving levels for temperatures by increment, wherein the first heat source is driven at a maximum driving level thereof, and the second heat source is driven at an input driving level for the second heat source that the input unit has received, until the cooking chamber reaches a preset reference temperature of the cooking chamber; if the cooking chamber reaches the reference temperature of the cooking chamber, the first heat source is driven at a preset driving level of the first heat source, and the second heat source is driven at a first preset driving level of the second heat source for a first preset time; and if the first preset time elapses, the second heat source is driven at a second preset driving level for a second preset time.

In another embodiment, a cooker includes: a cooking chamber in which food is cooked; a first heat source and a plurality of second heat sources providing heat to heat food in the cooking chamber; and an input unit receiving driving temperatures of the first and second heat sources as respective preset driving levels for temperatures by increment, wherein the first heat source is driven at a maximum driving level thereof, and the second heat source is driven at the input driving level of the second heat source received by the input unit, until the cooking chamber reaches a preset reference temperature of the cooking chamber; if the cooking chamber reaches the reference temperature of the cooking chamber, the first heat source is driven at a preset driving level of the first heat source, and the second heat source is driven at a first preset driving level of the second heat source for a first preset time; if the first preset time elapses, the second heat source is driven at a second preset driving level of the second heat source for a second preset time; if the second preset time elapses, the second heat source is driven at a third preset driving level for a third preset time; and the driving levels are divided into levels 1 through 10 that maintain the cooking chamber at temperatures of 300° F., 310° F., 320° F., 330° F., 340° F., 350° F., 375° F., 400° F., 425° F., and 450° F., respectively.

In further another embodiment, a method for controlling a cooker including a cooking chamber in which food is cooked; a first heat source and a plurality of second heat sources providing heat to heat food in the cooking chamber; and an input unit receiving manipulation signals including settings for driving temperatures of the first and second heat sources, for driving the first and second heat sources, the method comprising: driving the first heat source at a maximum driving temperature thereof and driving the second heat sources at an input driving temperature that the input unit has received until the cooking chamber reaches a preset reference temperature of the cooking chamber; and driving the first heat source at a preset driving temperature of the first heat source and driving the second heat source at a first preset driving temperature of the second heat source for a first preset time if the cooking chamber reaches the reference temperature of the cooking chamber.

The details of one or more embodiments are set forth in the accompanying drawings and the description below. Other features will be apparent from the description and drawings, and from the claims.

Advantageous Effects

According to the embodiments, foods can be more quickly and efficiently cooked.

DETAILED DESCRIPTION

Reference will now be made in detail to the embodiments of the present disclosure, examples of which are illustrated in the accompanying drawings.

Figure 1:
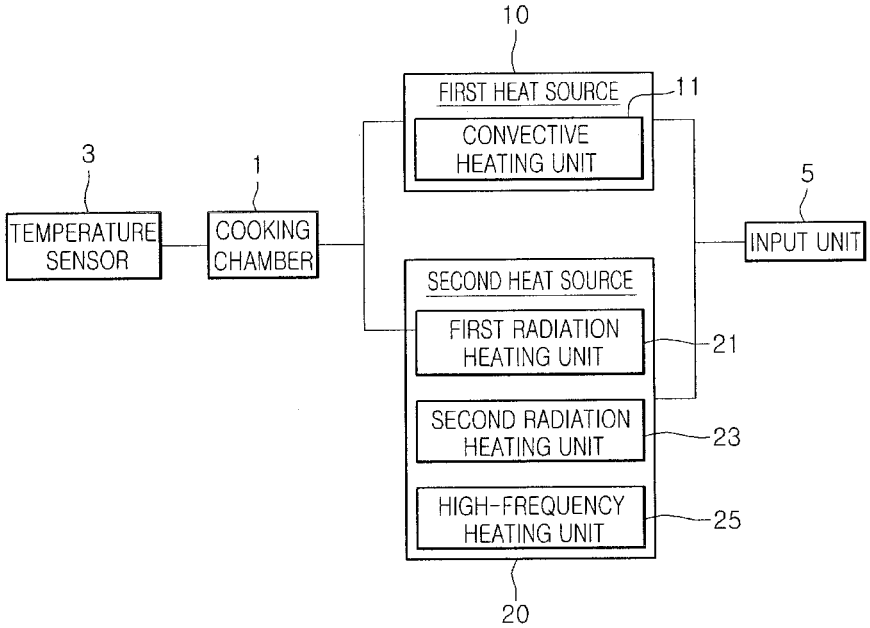
FIG. 1 is a block diagram illustrating a cooker according to an embodiment.

FIG. 1 is a block diagram illustrating a cooker according to an embodiment. Referring to FIG. 1, first and second heat sources 10 and 20 provide heat for heating food in a cooking chamber. A temperature sensor 3 detects the temperature of the cooking chamber. An input unit 5 receives manipulation signals for driving of the first and second heat sources 10 and 20. Specifically, the first heat source 10 includes a convective heating unit 11. The convective heating unit 11 performs convective heating of food in the cooking chamber 1. For example, the convective heating unit 11 may include a heater and a fan circulating air heated by the heater in the cooking chamber 1.

The second heat source 20 includes a plurality of heat sources. In this embodiment, the second heat source 20 includes a first radiation heating unit 21, a second radiation heating unit 23, and a high-frequency heating unit 25. The first and second radiation heating units 21 and 23 perform radiation heating of food in the cooking chamber 1. In this embodiment, a halogen heater may be used for at least one of the first and second radiation heating units 21 and 23. The high-frequency heating unit 25 discharges microwaves irradiated into the cooking chamber 1.

The input unit 5 receives manipulation signal for driving of the first and the second heat sources 10 and 20. In this case, the input unit 5 receives a driving temperature or a driving level with a preset temperature for each step as described in Table 1.

The input unit 5 receives a driving temperature or a driving level of the first and second heat source 10 and 20. Accordingly, a user may input the driving temperatures or driving levels of the convective heating source 11, the first and second radiation heating unit 21 and 23, and the high-frequency heating unit 25, respectively. Here, the driving temperatures and the driving levels of the first and second heat sources 10 and 20 inputted into the input unit 5 are set to a value that may maintain the temperature of the cooking chamber 1 to a predetermined temperature. For example, if the input unit 5 receives 350° F. or the driving level 1 as a driving level of the first and second heat sources 10 and 20, the first and second heat sources 10 and 20 maintain the temperature of the cooking chamber 1 at 350° F.

TABLE 1

| Operating Level | Temperature (° F.) |
|---|---|
| 1 | 300 |
| 2 | 310 |
| 3 | 320 |
| 4 | 330 |
| 5 | 340 |
| 6 | 350 |
| 7 | 375 |
| 8 | 400 |
| 9 | 425 |
| 10 | 450 |

The temperature sensor 3 may be located adjacent to the convective heating unit 11. This is because the temperature of the cooking chamber 1 is more easily affected by the convective heating unit 11 than the first and second radiation heating unit 21 and 23 partially heating the cooking chamber 1 or the high-frequency heating unit 25 vibrating the molecules of food.

The first heating source 10 is driven at the maximum driving level that the input unit 5 has received until the cooking chamber 1 reaches a preset reference temperature. In this case, the first heat source 10 is operated without an on/off until the temperature of the cooking chamber 1 reaches the reference temperature.

The reference temperature of the cooking chamber 1 is set according to the input driving temperature or the input driving level of the first heat source 10. For example, if the input unit 5 receives 350° F. or the driving level 1 as a driving temperature of the first heat source 10, the reference temperature of the cooking chamber 1 is set to 350° F.

Also, the first heat source 10 is driven at a preset driving temperature or preset driving level if the temperature of the cooking chamber 1 reaches the reference temperature of the cooking chamber 1. Here, the preset driving temperature or preset driving level of the first heat source 10 is set to a lower temperature or level of the input driving temperature or input driving level and the preset reference driving temperature or reference driving level of the first heat source 10. That is, if the input driving temperature or input driving level of the first heat source 10 is greater than the reference driving temperature or reference driving level of the first heat source 10, the preset driving temperature or preset driving temperature of the first heat source is set to a temperature or level identical to the reference driving temperature or reference driving level of the first heat source 10. However, if the input driving temperature or input driving level of the first heat source 10 is less than the reference driving temperature or reference driving level of the first heat source 10, the preset driving temperature or preset driving temperature of the first heat source is set to a temperature or level identical to the input driving temperature or input driving level of the first heat source 10. Thus, if the temperature of the cooking chamber 1 reaches the reference temperature of the cooking chamber 1, the first heat source 10 repeats on/off operations so that the cooking chamber 1 may maintain the temperature according to the preset driving temperature or preset driving level of the first heat source 10.

In this embodiment, the reference driving temperature or reference driving level of the first heat source 10 is set to 350° F. or the driving level 6. Accordingly, when the input driving temperature or input driving level of the first heat source 10 that the input unit 5 has received is more than 350° F. or a driving level 6, the first heat source 10 is driven at 350° F. or a driving level 6, and not the input driving temperature or input driving level of the first heat source 10 if the temperature of the cooking chamber 1 reaches the reference temperature of the cooking chamber 1. However, when the input driving temperature or input driving level of the first heat source 10 that the input unit 5 has received is less than 350° F. or a driving level 6, the first heat source 10 is driven at the input driving temperature or input driving level of the first heat source 10 if the temperature of the cooking chamber 1 reaches the reference temperature of the cooking chamber 1.

The second heat source 20 is driven at an input driving temperature or input driving level of the second heat source 20 that the input unit 5 has received until the temperature of the cooking chamber 1 reaches the reference temperature of the cooking chamber 1. Then, the second heat source is driven for a preset time at a preset driving temperature or preset driving level if the temperature of the cooking chamber 1 reaches the reference temperature of the cooking chamber 1.

Specifically, if the temperature of the cooking chamber 1 reaches the reference temperature of the cooking chamber 1, the second heat source 20 is driven for a first preset time at a first preset driving temperature or first preset driving level. Here, the first preset driving temperature or first preset driving level of the second heat source 20 is set according to a difference between an average of the input driving temperatures or input driving levels of the first and second heat sources 10 and 20 or preset average driving temperatures or preset average driving temperatures of the first and second heat sources 10 and 20. In this embodiment, when the first and second heat sources 10 and 20, that is, all of the convective heating unit 11, the first and second radiation heating unit 21 and 22, and the high-frequency heating unit 25 are driven, the first preset driving temperature or first preset driving level of the second heat source 20 is set a lower temperature or level of the input driving temperature or input driving level and a first reference driving temperature or first reference driving level of the second heat source 20 if the average of the input driving temperatures or input driving levels of the first and second heat sources 10 and 20 is more than the average driving temperature or average driving level of the first and second heat sources 10 and 20. However, the first preset driving temperature or first preset driving level of the second heat source 20 is set a temperature or level identical to the input driving temperature or input driving level of the second heat source 20 if the average of the input driving temperatures or input driving levels of the first and second heat sources 10 and 20 is less than the average driving temperature or average driving level of the first and second heat sources 10 and 20.

That is, in the condition that all of the first and second heat sources 10 and 20 are driven, if the average of the input driving temperatures or input driving levels of the first and second heat sources 10 and 20 is more than the average driving temperature or average driving level of the first and second heat sources 10 and 20, and if the input driving temperature or input driving level of the second heat source 20 is more than the first reference driving temperature or first reference driving level of the second heat source 20, the first preset driving temperature or first preset driving level of the second heat source 20 is set to a temperature or a level identical to the first reference driving temperature or the first reference driving level of the second heat source 20, respectively. If the input driving temperature or input driving level of the second heat source 20 is less than the first reference driving temperature or first reference driving level of the second heat source 20, the first preset driving temperature or first preset driving level of the second heat source 20 is set to a temperature or a level identical to the input driving temperature or the input driving level of the second heat source 20, respectively. However, in the condition that all of the first and second heat sources 10 and 20 are driven, if the average of the input driving temperatures or input driving levels of the first and second heat sources 10 and 20 is less than the average driving temperature or average driving level of the first and second heat sources 10 and 20, the first preset driving temperature or first preset driving temperature of the second heat source 20 is set a temperature or a level identical to the input driving temperature or input driving level, respectively.

In this embodiment, the average driving temperature or average driving level of the first and second heat sources 10 and 20, and the first reference driving temperature or first reference driving level of the second heat source 20 is set to 425° F. or a driving level 9, and 400° F. or a driving level 8, respectively. For example, when the input driving temperatures or input driving levels of the convective heating unit 11 and the first and second radiation heating unit 21 and 23 are 450° F. or a driving level 10, respectively, and the input driving temperature or input driving level of the high-frequency heating unit 25 is 350° F. or a driving level 6, the average of the input driving temperatures or input driving levels of the first and second heat sources 10 and 20 becomes 425° F. or a driving level 9. Therefore, the average of the input driving temperature or input driving level of the first and second heat sources 10 and 20 becomes greater than the average driving temperature or average driving level of the first and second heat sources 10 and 20. Thus, the first preset driving level and first preset driving level of the second heat source 20 is set to a lower temperature or level of the input driving temperature or input driving level of the second heat source 20 and the first reference driving temperature or first reference driving level of the second heat source 20. Accordingly, the first preset driving temperature or first preset driving level of the first and second radiation heating unit 21 and 23 is set to 400° F. or a driving level 8, respectively. The first preset driving temperature or first preset driving level of the high-frequency heating unit 25 is set to 350° F. or a driving level 6.

In other words, in the condition that all of the first and second are driven, the first preset driving temperature or first preset driving level of the second heat source 20 is set according to whether the sum of the input driving temperatures and input driving levels of the first and second heat sources 10 and 20 is greater or less than the sum of the preset driving temperatures or preset driving levels of the first and second heat sources 10 and 20. Here, the sum of the driving temperatures and driving levels of the first and second heat sources 10 and 20 becomes 1700° F. or a level 36.

If the first preset time lapses, the second heat source 20 is driven at a second preset driving temperature or a second preset driving level for a second preset time. In this case, the second preset driving temperature or second preset driving level of the second heat source 20 is set to a lower temperature or level of the input driving temperature or input driving level of the second heat source 20 and the second reference driving temperature or second reference driving level of the second heat source 20. In this embodiment, the second reference driving temperature or second reference driving temperature of the second heat source 20 is set to 375° F. or a level 7. If the second preset time lapses, the second heat source 20 is driven at a third preset driving temperature or a third preset driving level for a third preset time. In this case, the third preset driving temperature or third preset driving level of the second heat source 20 is set to a lower temperature or level of the input driving temperature or input driving level of the second heat source 20 and the third reference driving temperature or third reference driving level of the second heat source 20. In this embodiment, the third reference driving temperature or third reference driving temperature of the second heat source 20 is set to 340° F. or a level 5. The first to third preset times may be set to 10 minutes. If the second heat source 20 is driven at the first to third preset driving temperature or first to third preset driving level for the first to third preset times, the first heat source 10 is continuously driven at a preset driving temperature or preset driving level.

In this embodiment, the preset driving temperature or preset driving level of the first heat source 10, the first to third preset driving temperatures or first to third preset driving levels of the second heat source 20, and the first to third preset times are set as described above. However, it will be apparent that the preset driving temperature or preset driving level of the first heat source 10, the first to third preset driving temperatures or first to third preset driving levels of the second heat source 20, and the first to third preset times may be differently set according to the types and number of the first and second heat sources 10 and 20 and/or the maximum driving temperature or maximum driving level.

Hereinafter, a method for controlling a cooker according to an embodiment will be described in detail with reference to the accompanying drawings.

Figure 2:
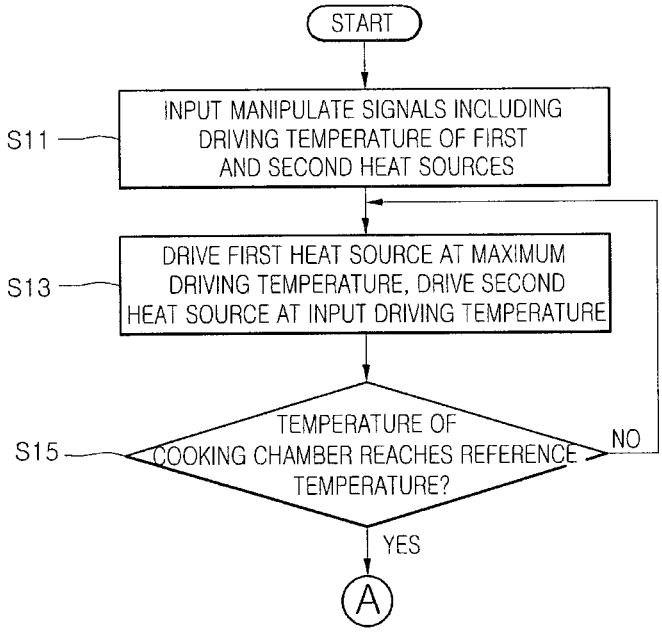
FIGS. 2 through 4 are flowcharts illustrating a method for controlling a cooker according to a first embodiment.
Figure 3:
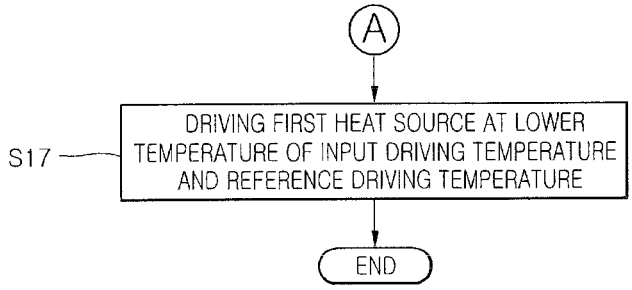
Figure 4:
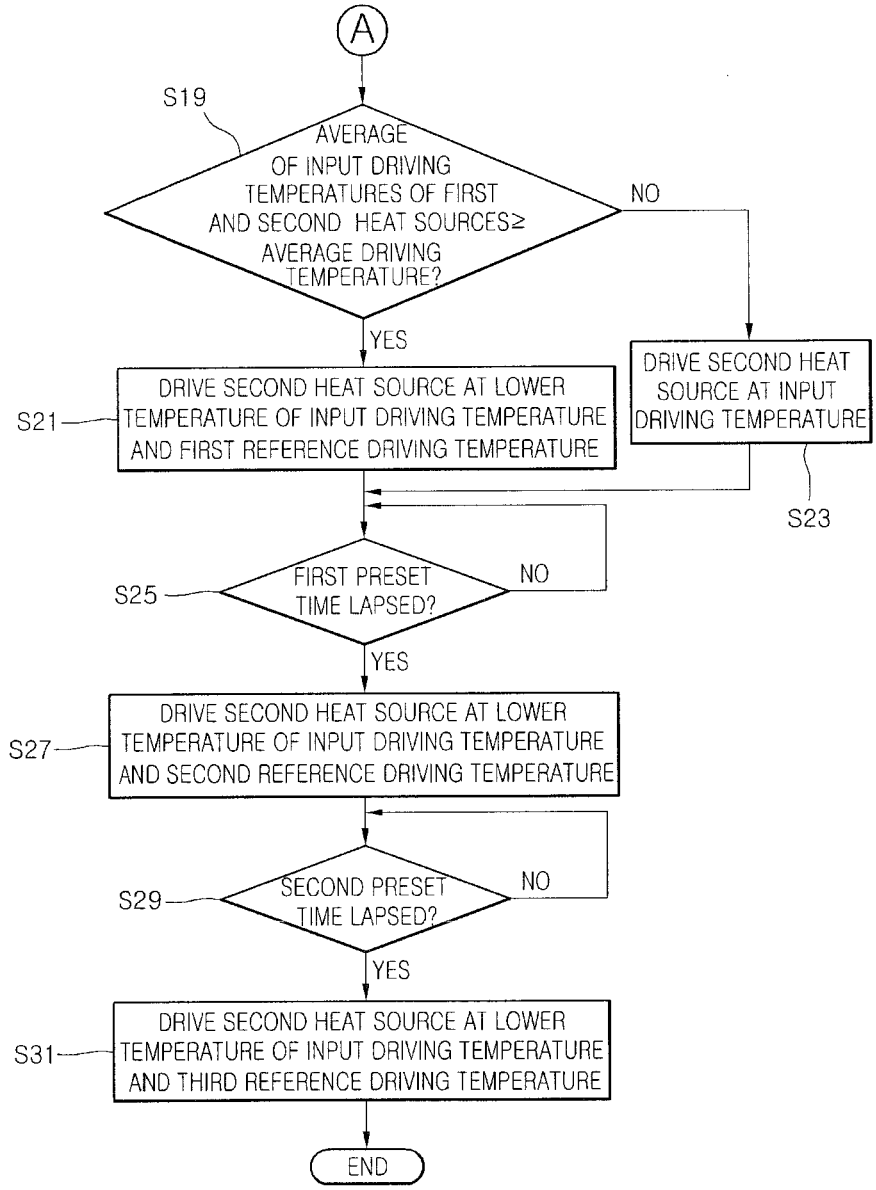

FIGS. 2 through 4 are flowcharts illustrating a method for controlling a cooker according to a first embodiment.

Referring to FIG. 2, in operation S11, an input unit 5 receives a manipulation signal for manipulating first and second heat sources 10 and 20. In the operation S11, the input unit 5 receives at least driving temperatures of the first and second heat sources 10 and 20, that is, input driving temperatures of the first and second heat sources 10 and 20.

In operation S13, the first heat source 10 is driven at the maximum driving temperature, and the second heat source 20 is driven at the input driving temperature that the input unit 5 has received in the operation S11. In the operation S13, the first heat source 10 is continuously driven without on/off operations.

In operation S15, if the first and second heat sources 10 and 20 are driven in the operation S13, it is determined whether the temperature of a cooking chamber 1 reaches a reference temperature. In the operation S15, the reference temperature of the cooking chamber 1 is set according to the input driving temperature of the first heat source 10.

Referring to FIG. 3, if it is determined that the temperature of the cooking chamber 1 has reached the reference temperature of the cooking chamber 1 in the operation S15, the first heat source 10 is driven at a preset driving temperature in operation S17. In the operation 17, the preset driving temperature of the first heat source 10 is set as described above. That is, the preset driving temperature of the first heat source 10 is set to a lower temperature of the input driving temperature of the first heat source 10 and the reference driving temperature preset in the first heat source 10. Also, the first heat source 10 repeats on/off operations to maintain the temperature of the cooking chamber 1 according to the preset driving temperature of the first heat source 10. The driving of the first heat source 10, that is, the driving of the first heat source 10 at the preset driving temperature is continued until first to third preset times as described below are lapsed.

Referring to FIG. 4, if it is determined that the temperature of the cooking chamber 1 has reached the reference temperature of the cooking chamber 1 in the operation S15, the second heat source 20 is driven at a first preset driving temperature in operations S19, S21 and S23. Specifically, in the operation S19, it is determined whether an average of the input driving temperatures of the first and second heat sources 10 and 20 is greater than an average driving temperature of the first and second heat sources 10 and 20. If it is determined that the average of the input driving temperature of the first and second heat sources 10 and 20 is greater than the average driving temperature of the first and second heat sources 10 and 20 in the operation S19, the second heat source 20 is driven at a lower temperature of the input driving temperature and a first reference driving temperature for a first preset time in the operation S21. However, If it is determined that the average of the input driving temperature of the first and second heat sources 10 and 20 is less than the average driving temperature of the first and second heat sources 10 and 20 in the operation S19, the second heat source 20 is driven at the input driving temperature for a first preset time in the operation S22.

In operation S25, it is determined whether the first preset time is lapsed after the driving of the second heat source in the operation S21 or S23. If it is determined that the first preset time is lapsed in the operation S25, the second heat source 20 is driven at a second preset driving temperature for a second preset time in operation S27. Specifically, the second source is driven at a lower temperature of the input driving temperature and a second reference driving temperature of the second heat source 20.

In operation S29, it is determined whether the second preset time is lapsed after the driving of the second heat source 20 in the operation S27. If it is determined that the second preset time is lapsed in the operation S29, the second heat source 20 is driven at a third preset driving temperature for a third preset time in operation S31. The second preset driving temperature of the second heat source 20 is set to a lower temperature of the input driving temperature and the second reference driving temperature of the second heat source 20.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

MODE FOR INVENTION

Hereinafter, a method for controlling a cooker according to a second embodiment will be described in detail with reference to the accompanying drawings.

Figure 5:
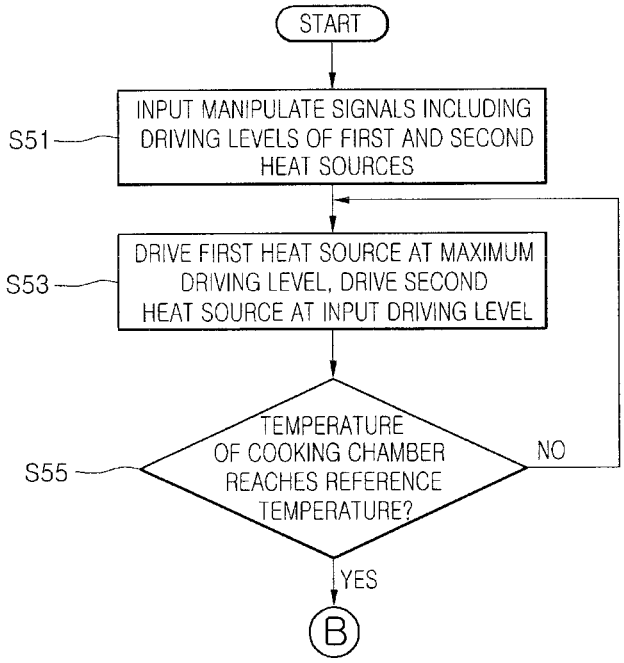
FIGS. 5 through 7 are flowcharts illustrating a method for controlling a cooker according to a second embodiment.
Figure 6:
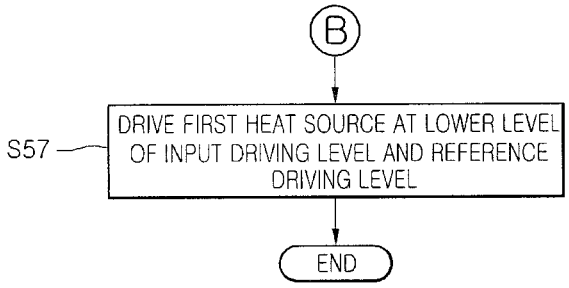
Figure 7:
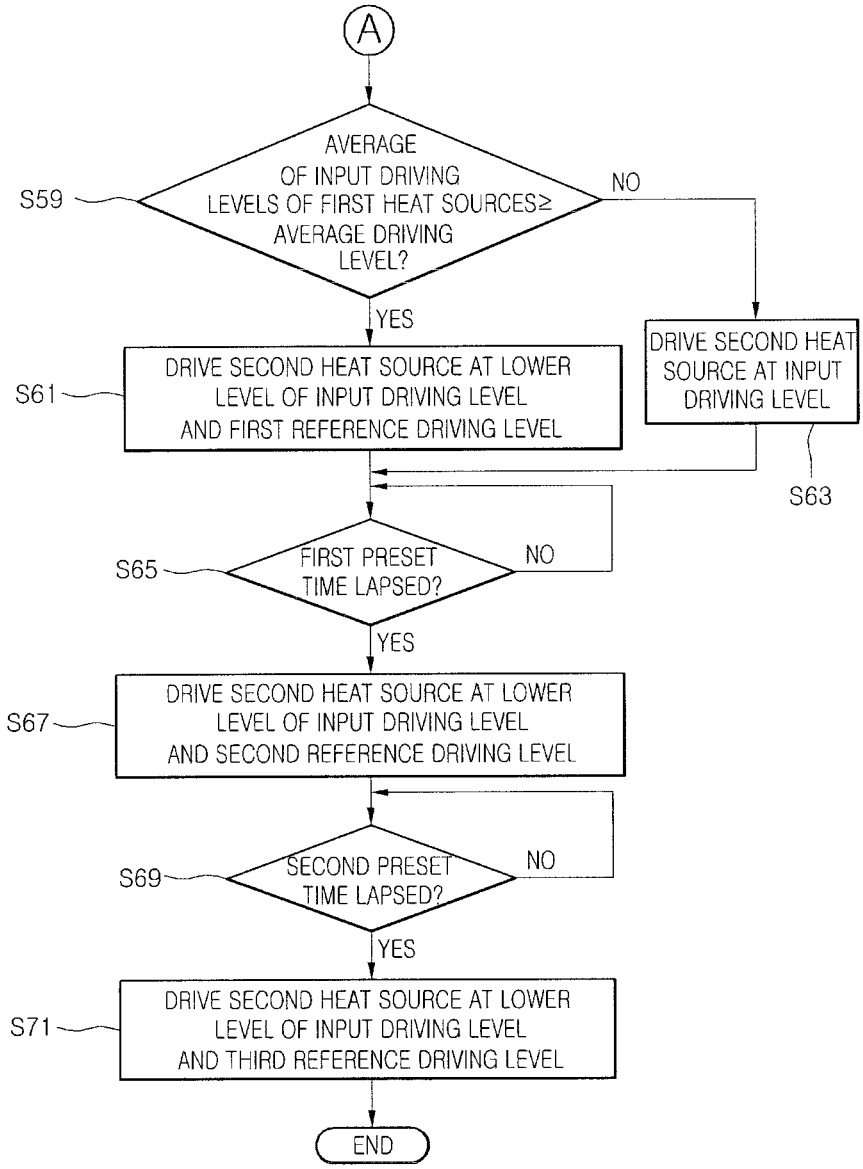

FIGS. 5 through 7 are flowcharts illustrating a method for controlling a cooker according to a second embodiment.

In this embodiment, unlike the method for controlling a cooker according to first embodiment, an input unit 5 receives driving levels for driving first and second heat sources 10 and 20.

Referring to FIG. 5, in operation S51, the input 5 receives manipulation signals for manipulating the first and second heat sources 10 and 20, at least driving levels for the first and second heat sources 10 and 20. In operation S53, the first heat source 10 is driven at the maximum driving level, and the second heat source 20 is driven at an input driving level of the second heat source 20 that the input unit 5 has received.

In operation S55, it is determined whether the temperature of a cooking chamber 1 reaches a reference temperature. Referring to FIG. 6, if it is determined that the temperature of the cooking chamber 1 has reached the reference temperature of the cooking chamber 1, in operation S57, the first heat source 10 is driven at a preset driving level. Referring to FIG. 7, if it is determined that the temperature of the cooking chamber 1 has reached the reference temperature of the cooking chamber 1, the second heat source 20 is driven at a first preset driving level in operations S59, S61, and S63.

On the other hand, if the second heat source 20 is driven at the first preset driving level, it is determined whether a first preset time is lapsed in operation S65. If it is determined that the first preset time is lapsed, the second heat source 20 is driven at a second preset driving level for a second preset time in operation S67.

Next, if the second heat source 20 is driven at the second preset driving level, it is determined whether the second preset time is lapsed in operation S69. If it is determined that the second preset time is lapsed, the second heat source 20 is driven at a third preset driving level for a third preset time in operation S71.

INDUSTRIAL APPLICABILITY

As described above, a cooker and a method for controlling the same according to an embodiment has the following effects.

First, a user can select driving and driving temperature of a plurality of heat sources. Accordingly, food can be more efficiently cooked according to the characteristics of each heat source.

Also, food can swiftly be cooked by the plurality of heat sources without being burned. Accordingly, a user can use a cooker more conveniently.

What is claimed is:

1. A cooker comprising:

a cooking chamber in which food is cooked;

a temperature sensor detects the temperature of the cooking chamber;

a first heat source and a plurality of second heat sources provide heat to heat food in the cooking chamber;

an input unit capable of receiving a driving temperatures or driving levels for the first and second heat sources, the driving temperatures are user's desired temperatures, and the driving levels correspond to preset driving temperatures; and a controller controls the first and second heat sources, and the controller is capable of detecting operation times of the first and second heat sources;

wherein the controller drives the first heat source at a maximum driving level thereof and drives the second heat source at an input driving level for the second heat source that the input unit has received, until the cooking chamber reaches a preset reference temperature of the cooking chamber;

if the temperature sensor detects that the cooking chamber reaches the reference temperature of the cooking chamber, the controller drives the first heat source at a preset driving level of the first heat source, and drives the second heat source at a first preset driving level of the second heat source for a first preset time; and if the first preset time elapses, the controller drives the second heat source at a second preset driving level for a second preset time.

2. The cooker according to claim 1, wherein the controller sets the reference temperature of the cooking chamber to a temperature of the cooking chamber that is maintained when the controller drives the first heat source according to the input driving level of the first heat source.

3. The cooker according to claim 1, wherein the controller sets the preset driving level of the first heat source to a lower level from among the input driving level of the first heat source and a preset reference driving level of the first heat source.

4. The cooker according to claim 3, wherein the reference driving level of the first heat source is a level at which the first heat source is driven to maintain the cooking chamber at a temperature of 350° F.

5. The cooker according to claim 1, wherein the controller continuously drives the first heat source until the cooking chamber reaches the reference temperature of the cooking chamber, and drives the first heat source with repeated on/off operations according to the preset driving level of the first heat source to maintain the temperature of the cooking chamber when the cooking chamber reaches the reference temperature of the cooking chamber.

6. The cooker according to claim 1, wherein the first preset driving level of the second heat source is a level that prevents food from being burned.

7. The cooker according to claim 1, wherein, if an average of the input driving levels of the first and second heat sources is greater than an average driving level of the first and second heat sources, the controller sets the first preset driving levels of the second heat sources respectively to a lower level from among the input driving levels of the second heat source and a preset first reference driving level of the second heat source, and if the average of the input driving levels of the first and second heat sources is less than the average driving level of the first and second heat sources, the controller sets the first preset driving levels of the second heat sources to a level identical to the respective input driving levels.

8. The cooker according to claim 1, wherein the controller sets the second preset driving level of the second heat source to be less than the first preset driving level of the second heat source.

9. The cooker according to claim 1, wherein the controller sets the second preset driving levels of the second heat sources respectively to a lower level from among the input driving level of the second heat source and a preset second reference driving level of the second heat source.

10. The cooker according to claim 1, wherein, if the second preset time elapses, the controller drives the second heat source at a third preset driving level for a third preset time.

11. The cooker according to claim 10, wherein the controller sets the third preset driving level of the second heat source to be less than the second preset driving level of the second heat source.

12. The cooker according to claim 10, wherein the controller sets the third preset driving level of the second heat source to a lower level from among the respective input driving levels of the second heat sources and a preset third reference driving level of the second heat source.

13. The cooker according to claim 1, wherein the driving levels are divided into levels 1 through 10 that maintain the cooking chamber at temperatures of 300° F., 310° F., 320° F., 330° F., 340° F., 350° F., 375° F., 400° F., 425° F., and 450° F., respectively.

14. The cooker according to claim 13, wherein, if the input driving level of the first heat source is identical to or greater than the level 6, the controller sets the preset driving level of the first heat source to the level 6, and if the input driving level of the first heat source is less than the level 6, the controller sets the preset driving level of the first heat source to a level identical to the input driving level of the first heat source.

15. The cooker according to claim 13, wherein the second heat source comprises three heat sources comprising a halogen heater, and when all of the first and second heat sources are driven, if a sum of the input driving levels of the second heat sources is identical to or greater than a level 36, the controller sets the first preset driving levels of the second heat sources having the input driving level of level 8 or more to the level 8, respectively, and the controller sets the first preset driving levels of the second heat sources having the input driving level of less than the level 8 to the respective input driving level, and if the sum of the input driving levels of the second heat sources is less than the level 36, controller sets the first preset driving levels of the second heat sources to the respective input driving level.

16. The cooker according to claim 13, wherein the controller sets the second preset driving levels of the second heat sources having the input driving level of the level 7 or more to the level 7, respectively, and the controller sets the second preset driving levels of the second heat sources having the input driving level of less than the level 7 to the input driving level, respectively.

17. A cooker comprising:

a cooking chamber in which food is cooked;

a temperature sensor detects the temperature of the cooking chamber;

a first heat source and a plurality of second heat sources provide heat to heat food in the cooking chamber;

an input unit capable of receiving driving temperatures or driving levels for the first and second heat sources, the driving temperatures are user's desired temperatures, and the driving levels correspond to preset driving temperatures; and a controller controls the first and second heat sources, and the controller is capable of detecting operation times of the first and second heat sources;

wherein the controller drives the first heat source at a maximum driving level thereof, and drives the second heat source at the input driving level of the second heat source received by the input unit, until the cooking chamber reaches a preset reference temperature of the cooking chamber;

if the temperature sensor detects that the cooking chamber reaches the reference temperature of the cooking chamber, the controller drives the first heat source at a preset driving level of the first heat source, and the second heat source at a first preset driving level of the second heat source for a first preset time;

if the first preset time elapses, the controller drives the second heat source a second preset driving level of the second heat source for a second preset time;

if the second preset time elapses, the controller drives the second heat source at a third preset driving level for a third preset time; and the driving levels are divided into levels 1 through 10 that maintain the cooking chamber at temperatures of 300° F., 310° F., 320° F., 330° F., 340° F., 350° F., 375° F., 400° F., 425° F., and 450° F., respectively.

18. The cooker according to claim 17, wherein, if the input driving level of the first heat source is identical to or greater than the level 6, the controller sets the preset driving level of the first heat source to the level 6, and if the input driving level of the first heat source is less than the level 6, the controller sets the preset driving level of the first heat source to a level identical to the input driving level of the first heat source.

19. The cooker according to claim 17, wherein the second heat source comprises three heat sources comprising a halogen heater, and when all of the first and second heat sources are driven, if a sum of the input driving levels of the second heat sources is identical to or greater than a level 36, the controller sets the first preset driving levels of the second heat sources having the input driving level of the level 8 or more to the level 8, respectively, and sets the first preset driving levels of the second heat sources having the input driving level of less than the level 8 to the respective input driving levels, and if the sum of the input driving levels of the second heat source is less than the level 36, the controller sets the first preset driving levels of the second heat source to the respective input driving level.

20. The cooker according to claim 17, wherein the controller sets the second preset driving levels of the second heat source having the input driving level of the level 7 or more to the level 7, respectively, and the controller sets the second preset driving levels of the second heat source having the input driving level of less than the level 7 to the respective input driving level.

21. The cooker according to claim 17, wherein the controller sets the third preset driving levels of the second heat sources having the input driving level of the level 5 or more to the level 7, and the controller sets the third preset driving levels of the second heat sources having the input driving level of less than the level 5 to the respective input driving level.

* * * * *